US010650674B2

(12) United States Patent
Engel et al.

(10) Patent No.: US 10,650,674 B2
(45) Date of Patent: May 12, 2020

(54) METHOD FOR ASSOCIATING A TRANSMITTER WITH A DETECTED OBJECT IN CAR-TO-CAR COMMUNICATION AND MOTOR VEHICLE

(71) Applicants: Audi AG, Ingolstadt (DE); Volkswagen AG, Wolfsburg (DE)

(72) Inventors: Sebastian Engel, Ingolstadt (DE); Michael Botsch, Ingolstadt (DE); Hendrik Rössler, Ingolstadt (DE)

(73) Assignees: Audi AG, Ingolstadt (DE); Volkswagen AG, Wolfsburg (DE)

( * ) Notice: Subject to any disclaimer, the term of this patent is extended or adjusted under 35 U.S.C. 154(b) by 765 days.

(21) Appl. No.: 14/055,468

(22) Filed: Oct. 16, 2013

(65) Prior Publication Data

US 2014/0104077 A1 Apr. 17, 2014

(30) Foreign Application Priority Data

Oct. 17, 2012 (DE) ..... 10 2012 020 297

(51) Int. Cl.
*G08G 1/0962* (2006.01)
*G08G 1/017* (2006.01)
(Continued)

(52) U.S. Cl.
CPC ..... *G08G 1/0962* (2013.01); *G08G 1/017* (2013.01); *G08G 1/0175* (2013.01);
(Continued)

(58) Field of Classification Search
CPC .. G08G 1/16; G08G 1/161–163; G08G 1/165; G08G 1/166
See application file for complete search history.

(56) References Cited

U.S. PATENT DOCUMENTS 6,397,141 B1 5/2002 Binnig
7,162,361 B2 * 1/2007 Heinrichs-Bartscher ..... 701/117
(Continued)

FOREIGN PATENT DOCUMENTS

DE 10 2008 010 119 11/2008
DE 102009014104 9/2009
(Continued)

OTHER PUBLICATIONS

Yusuke Takatori: "A study of driving assistance system based on a fusion network of inter-vehicle communication and in-vehicle external sensors", in: 14th International IEEE Conference on Intelligent Transportation Systems, Oct. 2011.
(Continued)

*Primary Examiner* — Ryan W Sherwin
(74) *Attorney, Agent, or Firm* — Henry M. Feiereisen LLC

(57) ABSTRACT

In a method for associating a transmitter which transmits at least one communication information in a car-to-car communication with an object in a receiving motor vehicle, wherein the object is described by environmental data from at least one environmental sensor, wherein the association occurs based on comparing environmental data from at least one environmental sensor of the motor vehicle having the transmitter with corresponding environmental data of the receiving motor vehicle.

5 Claims, 1 Drawing Sheet

(51) Int. Cl.
*G08G 1/0967* (2006.01)
*G08G 1/16* (2006.01)

(52) U.S. Cl.
CPC . *G08G 1/096716* (2013.01); *G08G 1/096758* (2013.01); *G08G 1/096791* (2013.01); *G08G 1/163* (2013.01); *G08G 1/166* (2013.01)

(56) References Cited

U.S. PATENT DOCUMENTS

| | | | | |
|---|---|---|---|---|
| 7,610,121 | B2 * | 10/2009 | Nishira | B60T 7/22 340/901 |
| 8,229,663 | B2 | 7/2012 | Zeng et al. | |
| 8,352,112 | B2 * | 1/2013 | Mudalige | 701/24 |
| 8,510,027 | B2 * | 8/2013 | Tajima et al. | 701/300 |
| 8,798,907 | B2 * | 8/2014 | Shida | G01S 5/0072 701/301 |
| 8,995,662 | B2 * | 3/2015 | Rubin et al. | 380/255 |
| 2009/0237293 | A1 | 9/2009 | Sakuma | |
| 2012/0101704 | A1 * | 4/2012 | Wagner | 701/96 |
| 2013/0060443 | A1 * | 3/2013 | Shida | 701/96 |

FOREIGN PATENT DOCUMENTS

| | | | |
|---|---|---|---|
| DE | 10 2010 006 084 | A1 | 10/2010 |
| DE | 10 2010 029 419 | A1 | 12/2010 |
| DE | 10 2010 013 647 | A1 | 2/2011 |
| DE | 10 2010 049 091 | A1 | 4/2012 |
| JP | 4602277 | | 12/2010 |
| WO | WO 99/26212 | | 5/1999 |
| WO | WO 2011/128739 | | 10/2011 |

OTHER PUBLICATIONS

Matthias Roeckl et al.: "Sensing the environment for future driver assistance combining autonomous and cooperative appliances", in: Fourth IEEE Workshop on Vehicle-to-Vehicle Communications, Jun. 2008.

Copy of Chinese Search Report dated May 5, 2015 with respect to counterpart Chinese patent application 201310478945.

Translation of Chinese Search Report dated May 5, 2015 with respect to counterpart Chinese patent application 201310478945.

* cited by examiner

METHOD FOR ASSOCIATING A TRANSMITTER WITH A DETECTED OBJECT IN CAR-TO-CAR COMMUNICATION AND MOTOR VEHICLE

CROSS-REFERENCES TO RELATED APPLICATIONS

This application claims the priority of German Patent Application, Serial No. 10 2012 020 297.0, filed Oct. 17, 2012, pursuant to 35 U.S.C. 119(a)-(d), the disclosure of which is incorporated herein by reference.

BACKGROUND OF THE INVENTION

The present invention relates to a method for associating a transmitter which transmits at least one item of communication information in car-to-car communication with an object described by environmental data of at least one environmental sensor in a receiving motor vehicle.

The following discussion of related art is provided to assist the reader in understanding the advantages of the invention, and is not to be construed as an admission that this related art is prior art to this invention.

In the state-of-the-art, systems have been proposed in which motor vehicles can wirelessly exchange items of communication information with each other or with infrastructure devices, in particular via radio transmission. Such exchange of data between motor vehicles and the infrastructure is referred to as car-to-car communication (C2C communication) in the specific situation of communication between motor vehicles, or as motor-vehicle-to-X-communication (C2X communication) in general situations. Standards for the exchanged items of communication information as well as for the radio communication itself have already been defined and are generally known in the art.

For example it is known to transmit as communication information the GPS position and/or the speed of a motor vehicle to other motor vehicles in the vicinity which are configured for car-to-car communication. Vehicle systems which receive the communication information from other motor vehicles via the radio channel and additionally know their own GPS position can calculate based on transformations, for example a UTM-transformation, the relative distances between the own receiving motor vehicle and the surrounding transmitting road users in a two-dimensional coordinate system. Thus, the car-to-car communication can figuratively speaking be modeled as a "sensor" which like actual environmental sensors of a motor vehicle, for example radar sensors, cameras, laser sensors and the like, detects the objects in its environment and measures their relative distances and speeds.

In the state-of-the-art, vehicle systems are also known which associate the communication information or communication objects received via the car-to-car communication with environmental data supplied by an environmental sensor. For example, environmental models are used in which the relative position of other objects is entered, wherein additional items of information can be associated with each of these objects, for example the relative speed and/or other properties of the object. Such environmental models can be enhanced with additional items of information relating to other vehicles by using the communication information, in particular those items of information that cannot be measured purely based on environmental sensors of the receiving motor vehicle. The masses of other motor vehicles, stiffness and the like are examples for such additional items of information.

For enabling such an association, it must first be determined with which object that is detected by the environmental sensors and that is described by the environmental data, a transmitter (a transmitting device) which has provided the communication information is associated. As described above, it is known in the art to determine a relative position and speed of the motor vehicle having the transmitter, hereinafter also referred to a s a host vehicle, from a GPS position and a transmitted speed as a car-to-car communication object. Relative positions and speeds of the environmental-sensor-objects that are detected by the environmental sensors are also known from the environmental data. These relative positions and speeds can now be compared for example by analyzing a Mahalanobis distance. When the environmental-sensor-object with which the sensor can be associated is identified, items of information from other vehicles contained in the items of communication information can accordingly be associated with this environmental-sensor-object.

The comparison of the relative positions originating from the same object (motor vehicle) but from different sources of information, namely the car-to-car information and the environmental sensors, is an important aspect for a successful comparison of data. While an environmental sensor can measure such relative positions very accurately, the calculation of the relative positions via the car-to-car communication is based on GPS-coordinates which according to the methods known to date can only be determined with insufficient accuracy.

Consequently, data received from another motor vehicle via the car-to-car communication and data determined by the environmental sensor from a corresponding object do not appear to belong together. An association would then erroneously not be possible because the relative distances or the relative positions do not match due to the inaccurate GPS data.

It would therefore be desirable and advantageous to provide an improved method to enable a more accurate and more reliable association of a transmitter with an object that is detected by environmental sensors in a receiving motor vehicle.

SUMMARY OF THE INVENTION

According to one aspect of the method of the present invention, at least one communication information is transmitted with a transmitter located in a host motor vehicle in the car-to-car communication to a receiving motor vehicle, and the at least one communication information is associated with an object being described by environmental data from at least one environmental sensor in the receiving motor vehicle by comparing environmental data contained in the at least one communication information from the at least one environmental sensor of the host motor vehicle with corresponding environmental data of the receiving motor vehicle.

According to an advantageous feature of the present invention, corresponding environmental data, i.e. environmental data which describe the same context, in particular a spatial context, may be compared, wherein however environmental data measured by environmental sensors of the receiving motor vehicle are compared with environmental data obtained via the car-to-car communication and determined by the motor vehicle that includes the transmitter and this vehicle's environmental sensor system. In principle, environmental data can be exclusively raw sensor data, however they are preferably derived from measurements, and are in particular relative positions. Thus, environmental data determined by measurements of the at least one environmental sensor of the motor vehicle that includes the sensor are not only transmitted as part of the communication information but they are analyzed in a targeted manner in the course of a comparison in order to identify the transmitting motor vehicle (by association with an object that was detected in the receiving motor vehicle with its environmental sensor system).

The other motor vehicles communicating via the car-to-car communication advantageously also include at least one environmental sensor. Such environmental sensors may include, for example, radar sensors, laser sensors, cameras, PMDs and the like. Such environmental sensors may provide extremely accurate measurement values from which spatial relationships, i.e. concretely positions relative to the measuring motor vehicle, can be determined. In addition to the conventionally transmitted items of communication information, each road user, i.e. each motor vehicle, now transmits via the car-to-car radio interface also the environmental data measured by its at least one own environmental sensor, i.e. a description of the environment. For example, a list of all objects detected in the vicinity of the motor vehicle having the sensor can be transmitted as environmental data, in particular a list containing relative positions and/or relative speeds of the objects, in the context of the communication information and thus also analyzed by the receiving motor vehicles.

By comparing the extremely accurate spatial information contained in the transmitted environmental data, each road user is now able to associate the communication information with an object detected in the environmental data of its environmental sensors.

Ideally, the items of communication information that are received via the radio channel of the car-to-car communication with objects detected by environmental sensors can now be unambiguously associated by using the method according to the invention. This is also the case when the GPS-position determination is inaccurate, because the object/motor vehicle which includes the sensor are no longer compared or the identified based on the transformed relative GPS-coordinates and the relative coordinates provided by an environmental sensor of the receiving motor vehicle, but rather associated exclusively based on environmental data determined by the different environmental sensors of the different road users and subsequently transmitted via the car-to-car communication and based on the environmental data of the receiving motor vehicle. Because the environmental data are detected by the environmental sensors with very high accuracy, the relative positions and optionally other comparative data have only a very small error, making the association more accurate and more reliable.

According to another advantageous feature of the present invention, the mutually detected motor vehicles may be identified in the environmental data of the respectively other motor vehicle by comparing the relative position contained in the environmental data of the communication information in relation to the motor vehicle having the sensor and a relative position to the receiving vehicle contained in the environmental data of the receiving vehicle. Accordingly, relative positions are compared wherein it is assumed that the motor vehicles communicating with each other "see" each other via their environmental sensors. Therefore, corresponding mutual relative positions must be present in the respective environmental data. As a result, a match is determined when the relative positions of matching, but opposing distance vectors match. When the relative positions are described by distance vectors, the distance vectors must have equal magnitude in opposite directions because they relate to different motor vehicles, thus allowing the pair of transmitter and receiver to be identified.

According to another advantageous feature of the present invention, relative speeds may also be included in the comparison in addition to the relative positions, wherein a match of the relative speeds is confirmed when the relative speed of an object relative to the motor vehicle having the transmitter corresponds to the negative of the relative speed of an object relative to the receiving motor vehicle. In this way, an additional item of available information is used to further improve the comparison and increase reliability.

Of course, a person with skill in the art will know that tolerance ranges, in particular those tolerance ranges that depend on the measuring accuracy must be taken into account in all comparisons when testing whether for example distance vectors and/or relative speeds or other parameters to be compared match.

In this way, additional data contained in the communication information may be added to the own environment, for example to an environmental model as described above. For example, at least one item of information from another vehicle relating to the other motor vehicle having the transmitter and contained in the communication information may be associated, based on the comparison result, with the motor vehicle having the transmitter and detected by the receiving motor vehicle by using the environmental sensor, in particular as extension of the data of an environmental model. In a particularly advantageous embodiment, such items of information from another vehicle may be information that cannot be measured by environmental sensors of the receiving motor vehicle itself, for example the weight of the transmitting motor vehicle, the stiffness of the transmitting motor vehicle and the like. For example, when the object of the environmental data is an object in an environmental model, identified as the transmitting motor vehicle (having the transmitter), items of information from other vehicles may be added as object properties and the like.

GPS-information still included in the communication information may advantageously also be used for a plausibility check, wherein the GPS-information of the motor vehicle having the transmitter is analyzed for checking the association. It can thus be checked whether analyzing a relative position obtained from the GPS-information yields the same object as the transmitting motor vehicle or whether the transmitting motor vehicle is at least included in a set of several possible transmitting objects.

In addition to the method, the invention also relates to a motor vehicle including a receiving device configured for receiving communication information transmitted by a transmitter, at least one environmental sensor, and a controller configured for implementing the method according to the invention. The receiving device is typically constructed as transmitting-receiving device (transceiver), which is thus configured not only for receiving communication information, but for operating as a transmitter. All embodiments relating to the method according to the invention equally apply to the motor vehicle according to the invention so that the advantages of the present invention can also be attained with the motor vehicle according to the invention. It is noted that the motor vehicle according to the invention may in particular be configured to transmit with the context of car-to-car communication at least a portion of its environmental data obtained from measurements of the environmental sensors, in particular in the form of a list of detected objects with their relative position and speed.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
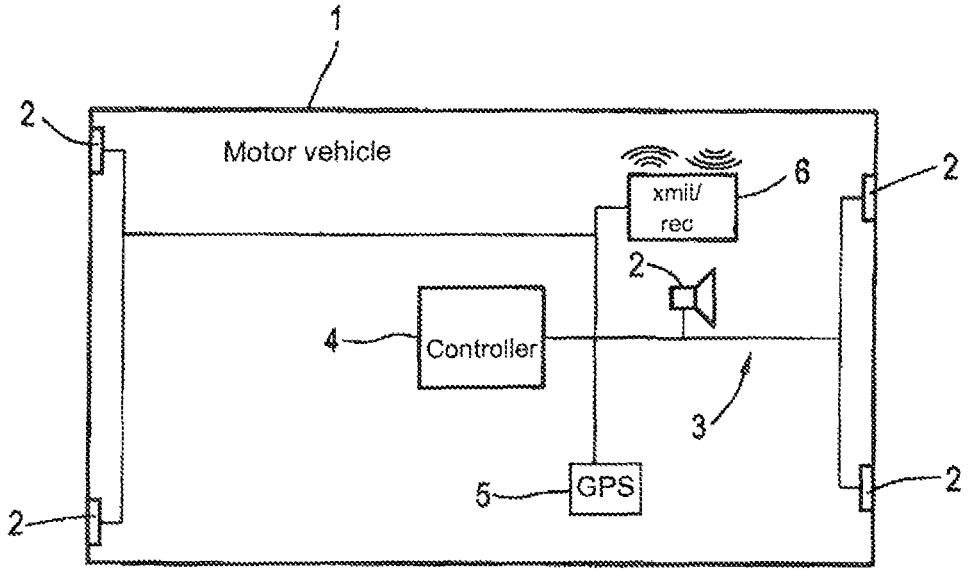
FIG. 1 shows a schematic diagram of a motor vehicle according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic diagram of a motor vehicle 1 according to the invention. As is generally known, the motor vehicle 1 has several environmental sensors 2 wherein radar sensors and a camera are shown here as examples. The environmental sensors 2 communicate via a bus system 3, for example a CAN-bus, with a controller 4 in which the data collected by the sensors are analyzed for the purpose of generating an environmental model that includes environmental data relating to objects detected in the surroundings of the motor vehicle 1, in particular relating to their position relative to the motor vehicle 1, allowing individual objects to be distinguished, and properties associated with these objects, for example their relative speed, the type of the object and the like.

The motor vehicle 1 also has a GPS sensor 5 for determining GPS-coordinates of the motor vehicle 1. Further provided is a transmitting-receiving device 6 for the car-to-car communication which can transmit communication information when configured as a transmitter and can receive, when the motor vehicle 1 is a receiving motor vehicle, communication information from other road users, in particular from additional motor vehicles, optionally also infrastructure objects.

The controller 4 is configured, on one hand, to transmit in the communication information also at least a portion of the environmental data, in particular a list of detected objects with their relative position and relative speed. On the other hand, the controller 4 is configured to carry out the method according to the invention when receiving communication information. I.e. the environmental data of the other motor vehicle contained in the communication information are analyzed by comparison with corresponding environmental data of the motor vehicle 1 in order to determine which detected object the motor vehicle that includes the transmitter corresponds to. It is noted that the GPS-information of the GPS sensor 5 is additionally transmitted and also received as part of the communication information.

For a concrete explanation of the method according to the invention, reference is made in the following to the traffic situation shown in FIG. 2.

Figure 2:
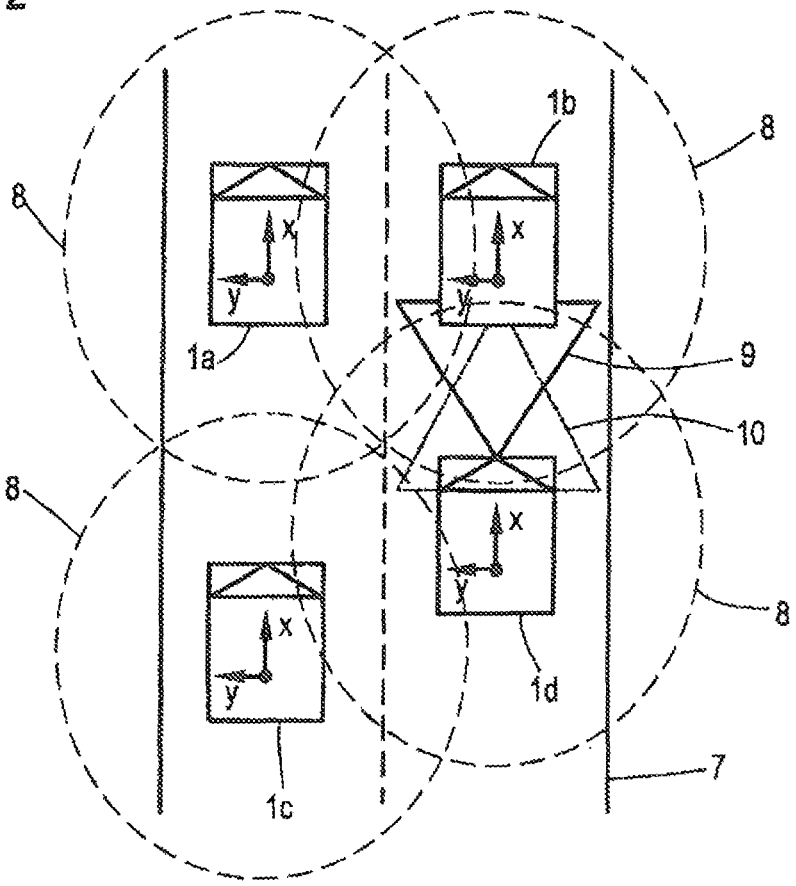
FIG. 2 shows a traffic situation with motor vehicles communicating within the context of car-to car communication.

As illustrated in FIG. 2, several motor vehicles 1*a* to 1*d* according to the invention drive on a road 7 in the same direction. Relative positions in the environmental data of each of the motor vehicles 1*a* to 1*d* are described in vehicle-coordinate systems with the coordinates x and y which for clarity are shown inside the motor vehicles.

FIG. 2 also shows several exemplary ellipses 8 illustrating the inaccuracy of the GPS position determination. As also seen from the exemplary detection range 9 of an environmental sensor 2 of the motor vehicle 1*d*, the motor vehicle 1*d* can detect the motor vehicle 1*b*, in particular via a relative position and speed. However, due to the inaccurate GPS positions of all motor vehicles 1*a* to 1*d*, the motor vehicle 1*d* is unable to determine which of the received items of communication information originate from motor vehicle 1*b*.

However, as shown in the example, the motor vehicle 1*b* can detect the motor vehicle 1*d* via a rear environmental sensor 2 having the detection range 10. At the same time, the motor vehicle 1*b* receives the data of the surrounding motor vehicles 1*a*, 1*c* and 1*d*, but is again unable to determine, due to the inaccurate GPS positions, which items of communication information originate from motor vehicle 1*d*.

In order to nevertheless enable association of the received communication information with another motor vehicle 1*a* to 1*d*, i.e. to be able to identify an object detected by the environmental sensor system of the receiving motor vehicle as the motor vehicle which has the transmitter, i.e. the transmitting motor vehicle, environmental data originating from measurements of the environmental sensors 2 are transmitted by all motor vehicles 1*a* to 1*d* as part of the communication information in addition to the usually transmitted data of the communication information, in actual situations lists of detected objects with their relative positions and relative speeds.

In the following, an example for the vehicle 1*b* and an not yet further identified) object with the relative distances $x_b$ in vehicle's longitudinal direction and $y_b$ in the vehicle's transverse direction will be described. The motor vehicle 1*d* also transmits an (not yet further identified) object with the relative distances $x_d$ in vehicle's longitudinal direction and $y_d$ in the vehicle's transverse direction.

When it is to be determined in motor vehicle 1*b* which communication information transmitted per radio transmission originates from motor vehicle 1*d* located behind the motor vehicle 1*b*, the relative positions received per radio transmission are compared with the relative positions provided by the environmental sensors 2 of the motor vehicle 1*b*. The relative distances measured in the environmental data of motor vehicle 1*b* are designated as $x_2$ and $y_2$. As a result of the geometric constellation, the relationship $x_2=x_d$ and $y_2=y_d$ applies. Accordingly, the motor vehicle 1*b* can determine the communication information associated with the motor vehicle 1*d* located behind. This is the communication information containing the relative distances $-x_2$ and $-y_2$ (i.e. $x_d$ and $y_d$). This is thus the communication information of the motor vehicle 1*d*. The motor vehicle 1*d* can thereby unambiguously associate all the communication information transmitted by the motor vehicle 1*d* to the motor vehicle 1*d*. For example, information from other vehicles, in particular the weight, stiffness or other data that cannot be measured by the environmental sensor 2, can be associated with the environmental data of the motor vehicle 1*d*, in particular the environmental model, because this information from other vehicles is transmitted simultaneously with the relative positions.

Likewise, the motor vehicle 1*d* measures with its sensor system 2 an object with the relative distances $x_4$ and $y_4$ located in front of the motor vehicle 1*d*. Due to the constellation $x_4=-x_b$ and $y_4=-y_b$, the motor vehicle 1*d* can associate the communication information of the motor vehicle 1*b* directly with the motor vehicle 1*b*.

Although only a single object detected by the environmental sensors 2 was discussed to simplify the discussion, the method can of course also be carried out when the environmental sensors 2 detect several objects and thus several relative distances are transmitted, wherein only the comparison needs to be performed for all received environmental data and measured environmental data.

It is noted here that the relative speeds can also be compared to each other to further improve of the identification. Moreover, a plausibility check in the form of an identification via GPS information may be performed and compared with the result of the comparison of the environmental data. The GPS information can also be used as a fallback solution when for example a transmitting motor vehicle is not detected by the environmental sensors 2.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A method for unambiguously identifying in car-to-car communication an object having a transmitter located therein and being associated with at least one remote vehicle in relation to a host vehicle, comprising:

detecting with an environmental sensor of the host vehicle, the at least one remote vehicle and determining based on first environmental data from the environmental sensor of the host vehicle at least one of a first relative distance and a first relative speed between the host vehicle and the object, transmitting, with the transmitter located in the object, in the car-to-car communication to the host vehicle at least one communication information containing second environmental data comprising a second relative distance and a second relative speed between the host vehicle and the object obtained with an environmental sensor of the object and describing the object to the host vehicle, said first and said second environmental data excluding a use of Global Positioning System (GPS) data, comparing in a controller of the host vehicle the first environmental data with the second environmental data, and ascertaining an unambiguous identification when at least one of the first relative distance and the first relative speed corresponds to a negative value of the corresponding second relative distance or the second relative speed among the at least one remote vehicle based on the comparison.

2. The method of claim 1, wherein the first environmental data and the second environmental data are compared by analyzing a list of all objects detected in a vicinity of the host vehicle.

3. The method of claim 1, further comprising associating, based on the comparison result, at least one item of the at least one communication information describing the object with the first environmental data of the host vehicle.

4. The method of claim 1, further comprising a performing a plausibility check of the unambiguous identification by additionally evaluating GPS information contained in the at least one communication information of the remote vehicle.

5. A host vehicle, comprising:

a receiving device configured to receive at least one communication information transmitted in a car-to-car communication by a transmitter located in at least one remote vehicle and containing environmental data describing an object associated with the at least one remote vehicle, the host vehicle further comprising at least one environmental sensor configured to detect the at least one remote vehicle and determine based on first environmental data from the at least one environmental sensor of the host vehicle at least one of a first relative distance and a first relative speed between the host vehicle and the object, and a controller in the host vehicle configured to:

receive from the transmitter located in the at least one remote vehicle in the car-to-car communication at least one communication information containing second environmental data comprising a second relative distance and a second relative speed between the host vehicle and the object obtained with an environmental sensor of the at least one remote vehicle and describing the object to the host vehicle, said first and said second environmental data excluding a use of Global Positioning System (GPS) data, compare the first environmental data with the second environmental data, and ascertain an unambiguous identification when at least one of the first relative distance and the first relative speed corresponds to a negative value of the corresponding second relative distance or the second relative speed among the at least one remote vehicle based on the comparison.

* * * * *